United States Patent [19]

Hazenbosch et al.

[11] 4,078,932

[45] Mar. 14, 1978

[54] HARDENING DEVELOPERS FOR SILVER HALIDE PHOTOGRAPHY

[75] Inventors: Edwin Hendrik Hazenbosch, Mechlin; Marcel Frans Aelterman, Mortsel; Gerard Laurens Vanreusel, Hove, all of Belgium

[73] Assignee: AGFA-Gevaert N.V., Mortsel, Belgium

[21] Appl. No.: 678,633

[22] Filed: Apr. 20, 1976

[30] Foreign Application Priority Data

May 1, 1975 United Kingdom ..... 18240/75

[51] Int. Cl.[2] ..... G03C 5/30

[52] U.S. Cl. ..... 96/66 R; 96/66.1

[58] Field of Search ..... 96/111, 66.1, 66.3, 96/66 R, 50 R; 260/615 A, 615 AA

[56] References Cited

U.S. PATENT DOCUMENTS

| | | | |
|---|---|---|---|
| 2,172,300 | 9/1939 | Staud et al. | 96/111 |
| 2,868,773 | 1/1959 | Kress | 96/111 |
| 3,030,209 | 4/1962 | Henn et al. | 96/66.3 |
| 3,294,536 | 12/1966 | Baden et al. | 96/111 |
| 3,304,179 | 2/1967 | Field | 96/50 R |
| 3,451,817 | 6/1969 | Bard et al. | 96/111 |
| 3,677,760 | 7/1972 | Iwano et al. | 96/111 |
| 3,762,926 | 10/1973 | Himmelmann et al. | 96/111 |
| 3,901,708 | 8/1975 | Ugi et al. | 96/50 PT |

*Primary Examiner*—Mary F. Kelley
*Attorney, Agent, or Firm*—A. W. Breiner

[57] ABSTRACT

A hardening developer is described which comprises at least one silver halide developing agent and a reaction product of a dialdehyde hardener with an aliphatic alcohol.

20 Claims, No Drawings

HARDENING DEVELOPERS FOR SILVER HALIDE PHOTOGRAPHY

The present invention relates to hardening developers for the development of exposed silver halide material.

In the formation of a stable visible image, a silver halide emulsion layer containing a latent image by image-wise exposure to radiation is developed, fixed, washed and dried.

In order to reduce processing time and to permit handling of large amounts of exposed photographic materials, automatic processing machines are used to develop, fix, wash and dry exposed photographic materials e.g. radiographic materials. In these automatic processing machines the material is guided from one processing station to another and loss of activity of the processing solution is counteracted by continual replenishment and by introducing fresh processing solutions periodically.

In these automatic processing machines, processing can occur at elevate temperature (above 30°0 C) in order to reduce processing time. For the processing at elevated temperature the emulsions usually have a low ratio of binder, more particularly gelatin, to silver halide, e.g. comprised between about 3:10 and about 7:10 and the development occurs by means of a hardening developer in order to avoid softening and excessive swelling of the emulsions with low binder to silver halide ratio. These hardening developers preferably contain dialdehyde hardeners since they allow rapid development of the material before hardening of the layers begin to diminish the permeability thereof.

It is common practice to prepare hardening developers ready for use from a number of liquid concentrates which are admixed and diluted with water. One of these concentrates comprises the hardening agent, more particularly a dialdehyde hardener e.g. glutaraldehyde, or its bisulphite addition product. The other concentrate(s) comprise the silver halide developing agent or agents, alkali, development accelerators, antifoggants, calcium-sequestering compounds, antioxidizing agents and other known ingredients used for preparing developing compositions.

For the development of exposed radiographic (X-ray) silver halide materials usually three liquid concentrates are provided for the formation of the developing composition:

(A) a concentrate comprising a hydroquinone developing agent, alkali, usually suffisient to obtain a pH above 11 to avoid precipitation of a hydroquinone developing agent, anti-oxidizing agents e.g. sulphites and/or bisulphites, development restraining salts e.g. potassium bromide, potassium chloride, and/or potassium iodide, etc.

(B) a concentrate comprising an auxiliary developing agent which has a superadditive effect when used together with a hydroquinone development agent, e.g. a 3-pyrazolidinone compound, more particularly 1-phenyl-3-pyrazolidinone or other substituted 3-pyrazolidinones, and (C) a concentrate comprising a dialdehyde hardener or a bisulphite addition product of the dialdehyde hardener which may be formed by using, in formulating the hardener concentrate, a bisulphite e.g. potassium metabisulphite, in addition to the dialdehyde hardener.

The liquid concentrates have high stability and thus long storage life before mixing. However, after mixing, the dialdehyde hardener gradually looses its hardening activity probably due to reaction with the hydroquinone developing agent or oxidation products thereof. The loss in activity occurs more rapidly as the pH of the developer is higher and becomes particularly pronounced at pH values above 10.5.

In accordance with the present invention, hardening developers are provided which have longer operational life with maintenance of hardening effect, even at pH values as high as 11.0.

Surprisingly it has been found that when a solution of a dialdehyde hardener in an acidic medium together with an aliphatic alcohol was stored for a couple of weeks at room-temperature before being added to an alkaline developing composition comprising a hydroquinone silver halide developing agent, the hardening developer formed had substantially improved stability against regression of hardening effect than when such solution was directly added after preparation or when an alcohol-containing solution and a dialdehyde containing solution are added separately. Moreover owing to the high stability, the pH of the hardening developer could be increased which results in an acceleration of development.

The improved stability would appear to be due to some kind of reaction product that gradually forms in the solution between the dialdehyde hardener and the aliphatic alcohol. This reaction product does not form in the alkaline developer medium. The reaction product does form, however, not only under acidic conditions but also in a neutral medium of the alcohol although at a slower rate so that ample time should be left for the reaction product to form upon storage. It was also found that the reaction product forms more rapidly at elevated temperature so that the beneficial effects of the invention are also obtained by addition of an acidic alcoholic solution of the aldehyde hardener stored for only a few days at about 60° C.

The exact structure of the reaction product cannot be defined but it is probably a matter of acetal and/or hemiacetal formation on one or both aldehyde groups of the dialdehyde hardener. How unlikely this may seem to be knowing that acetals in acid medium hydrolyse to form aldehydes evidence in this direction is set forth in example 2 hereinafter.

The knowledge of the exact structure of the reaction product is of minor importance, however, since it can be formed by simple storing of a dialdehyde hardener solution in an alcoholic medium, formulated for admixture with the other developer ingredients to form a hardening developing composition ready for use for the development of exposed silver halide elements. In practice, there can be always sufficient storage time between preparation of the dialdehyde hardener solution and its admixture with the other developer ingredients.

In its broadest aspect the present invention thus provides a hardening developer for the development of exposed silver halide material, comprising at least one silver halide developing agent and a reaction product of a dialdehyde hardener with an aliphatic alcohol.

This reaction product is one which is capable of formation by storing a composition formed by an aqueous solution of the dialdehyde hardener and the aliphatic alcohol under neutral or acidic conditions.

More particularly, the present invention provides a hardening developer formed by admixture of a preformed hardener being a reaction product of a dialdehyde hardener and an aliphatic alcohol with common developer ingredients to form a developing composition ready for use.

The invention also includes a method of preparing a silver halide developer composition, which method comprises forming an acid or neutral composition which comprises a reaction product of a dialdehyde hardener with an aliphatic alcohol and subsequently, mixing such composition with an alkaline developer composition containing a silver halide developing agent.

According to a preferred embodiment of the present invention the reaction product is formed in situ by storing a mixture of the dialdehyde and the aliphatic alcohol in acid or neutral for a few weeks e.g. about two to three weeks at room temperature if the mixture has a pH between about 2 and about 5.

The invention provides thus also a liquid hardening developer concentrate comprising at least two separate parts which by admixture and dilution with water form a hardening developer ready for use wherein one of the parts comprises a reaction product of a dialdehyde hardener with an aliphatic alcohol in acidic or neutral medium e.g. formed in situ by storing a composition of aqueous dialdehyde and aliphatic alcohol.

It is surprising that although the reaction product of the dialdehyde hardener with the aliphatic alcohol prevents reaction of the aldehyde with the hydroquinone compound in alkaline medium, it does not prevent hardening of the hydrophilic colloid layers of the photographic material developed.

The invention is concerned with hardening developers based on dialdehydes as hardening agents. Dialdehyde hardeners for use in the development of exposed silver halide material are well known. Usually aliphatic dialdehydes are employed, more particularly those the aldehyde functions of which are separated by a hydrocarbon chain of 2 or 3 carbon atoms which may be interrupted by oxygen. Representative examples of suitable dialdehyde hardeners for use according to the present invention are glutaraldehyde, α-methylglutaraldehyde, β-methylglutaraldehyde, α-butoxyglutaraldehyde, α-methyl-β-ethoxyglutaraldehyde, α,α-dimethylglutaraldehyde, α,β-dimethylglutaraldehyde, maleindialdehyde, butylmaleindialdehyde, succindialdehyde, methylsuccindialdehyde, methoxysuccindialdehyde, β-isopropoxysuccindialdehyde, diglycolaldehyde ($OHCCH_2OCH_2OCH$), etc. The most preferred dialdehyde hardener is glutaraldehyde.

Examples of aliphatic alcohols suitable for use in accordance with the present invention to form a reaction product with the dialdehyde hardener are aliphatic alcohols having a boiling point above 100° C the boiling point of water and include monoalcohols as well as polyols. The alcohols are preferably such that the reaction products are completely soluble in the alkaline developer medium. Representative examples are n-butanol, benzylalcohol, ethylene glycol, ethylene glycol monomethyl ether, ethylene glycol monoethyl ether, diethylene glycol, triethylene glycol, glycerol, etc. The preferred alcohols are glycols as well as monoalkyl ethers thereof wherein the alkyl group is a lower alkyl group.

The reaction product of aldehyde with aliphatic alcohol forms more rapidly in an acidic medium. This medium preferably has a pH between about 2 and about 5, more preferably between 2.5 and 3.5. Particularly suitable acids for adjusting the alcoholic medium to these pH values are inorganic acids e.g. hydrochloric acid and lower aliphatic organic acids e.g. acetic acid, propionic acid and citric acid. The preferred acid is acetic acid.

The hardening developers of the present invention preferably comprise an amount of reaction product of dialdehyde hardener with aliphatic alcohol corresponding to an amount of dialdehyde hardener between about 2 g and about 10 g per liter.

In the preparation of the hardening developer ready for use, a preferred embodiment may be to start from concentrated solutions one of them containing the higher mentioned reaction product made by mixing a dialdehyde with an aliphatic alcohol.

This concentrated solution preferably comprises an amount of hardening agent in the form of a reaction product with the alcohol corresponding to an amount of free aldehyde between about 2 g and about 10 g per liter of hardening developer ready for use.

The liquid hardener concentrate may be prepared from about 40 g to 200 g of dialdehyde hardener, preferably glutaraldehyde, an amount of lower aliphatic acid preferably acetic acid and an amount of aliphatic alcohol, preferably diethylene glycol to obtain 1 liter of solution having a pH between about 2 and about 5, preferably between 2.5 and 3.5.

In the development of photographic silver halide elements it is preferred to use in addition to the hydroquinone developing agent a minor amount of an auxiliary developing agent providing a superadditive effect with the hydroquinone developing agent. These auxiliary developing agents include: 3-pyrazolidinones, e.g. 1-phenyl-3-pyrazolidinone, 1-phenyl-4-phenyl-3-pyrazolidinone, 1-phenyl-4,4-dimethyl-3-pyrazolidinone, 1-phenyl-4-methyl-3-pyrazolidinone, 1-phenyl-5-methyl-3-pyrazolidinone and the like, aminophenols e.g. o-aminophenol, p-aminophenol, N-methyl-o-aminophenol, N-methyl-p-aminophenol, 2,4-diaminophenol and the like.

The auxiliary developing agent can be successfully incorporated in the hardener solution for admixture with the common developer ingredients to form a hardening developer ready for use according to the present invention.

In addition to the auxiliary developing agent e.g. a 3-pyrazolidinone developing agent, the preferred representatives of which are 1-phenyl-3-pyrazolidinone and 1-phenyl-4-methyl-3-pyrazolidinone, the liquid hardener solution can also comprise organic antifoggants e.g. antifoggants normally used in aldehyde containing developers which include mercapto compounds e.g. 1-phenyl-5-mercaptotetrazole, benztriazole compounds e.g. benztriazole and methylbenztriazole, nitrocompounds e.g. 5-nitroindazole, 6-nitrobenzimidazole, nitrobenztriazole and other heterocyclic compounds carrying nitro groups e.g. of the type described in the French Specification No. 2,008,245 filed May 9, 1969 by Eastman Kodak Co. Further the liquid hardener solution may comprise other common development ingredients that are soluble in the medium e.g. bisulphites such as potassium metabisulphite.

In the preparation of a hardening developer ready for use according to the present invention a reaction product of a dialdehyde hardening agent and an aliphatic alcohol, which may be formed in situ in solution, is mixed with common developer ingredients which include alkali e.g. sodium or potassium hydroxide and/or sodium or potassium carbonate, silver halide developing agents e.g. a dihydroxybenzene silver halide developing agent which include hydroquinone, and hydroquinone derivatives e.g. chlorohydroquinone, bromohydroquinone, isopropylhydroquinone, toluhydroquinone, methylhydroquinone, 2,3-dichlorohydroquinone, 2,5-dimethylhydroquinone and the like, or other known developing agents e.g. ascorbic acid as well as the superadditive developing agents referred to hereinbefore.

The ingredients further include development restraining salts, e.g. potassium bromide, potassium chloride, and/or potassium iodide, developer preservatives e.g. sulphites and bisulphites, e.g. sodium sulphite, potassium metabisulphite, antifoggants e.g. mercapto compounds like 1-phenyl-5-mercaptotetrazole, development accelerating onium compounds e.g. of the type described in U.S. Pat. No. 3,682,634 and 3,713,827 of Jozef Frans Willems issued respectively Aug. 8, 1972 and Jan. 30, 1973, e.g. 1,1'-tetramethylenebis(pyridinium chloride) and 1,1'-ethylene-2,2'-dipyridinium dibromide, polyoxyalkylene compounds e.g. polyethylene glycols and esters thereof, Ca-sequestering agents e.g. sodium hexametaphosphate, salts of ethylene diamine tetraacetic acid and nitrilotriacetic acid, wetting agents, etc. The hardening developer ready for use may also comprise free dialdehyde hardener added thereto.

The developer ingredients are admixed with a reaction product of a dialdehyde and an aliphatic alcohol, wherein the reaction product may have been formed in situ in a solution as referred to hereinbefore e.g. a hardener concentrate to form a hardening developer of the present invention. As is common in the art these ingredients may form part of an alkaline concentrate, e.g. a concentrate comprising the ingredients dissolved therein in amounts from 2 to 5 times the amounts normally employed in the developing composition ready for use.

The photographic elements for being developed by means of a hardening developer of the present invention comprise a support with at one or both sides thereof at least one silver halide emulsion layer. The emulsion may comprise as light-sensitive silver halide: silver bromide, silver chloride or mixed silver halides e.g. silver chlorobromide, silver chlorobromoiodide, silver bromoiodide, and silver chloroiodide. The hardening developers of the present invention are particularly suitable for rapid development at elevated temperature of radiographic silver halide elements comprising as light-sensitive silver halide silver bromide or silver bromoiodide the iodide content being generally at most 5 mole %.

The emulsions can be chemically sensitized by any of the accepted procedures. The emulsions can be digested with naturally active gelatin or with sulphur containing compounds such as allyl isothiocyanate, allyl thiourea or sodium thiosulphate. The emulsions can also be digested in the presence of reducing agents e.g. the tin compounds described in Belgian Pat. Nos. 493,464 filed Jan. 24, 1950 and 568,687 filed June 18, 1958 both by Gevaert Photo-Producten N. V., the imino-amino methane sulphinic acid compounds described in United Kingdom Patent Specification No. 789,823 filed Apr. 29, 1955 by Gevaert Photo-Producten N. V., polyamines e.g. diethylene triamine, spermine and bis(β-aminoethyl)sulphide. They can further be digested in the presence of noble metal compounds such as ruthenium, rhodium, palladium, iridium, platinum and gold compounds as described by R. Koslowsky, Z. Wiss. Phot. 46, 65–72 (1951). Representative compounds are ammonium chloropalladate, potassium chloroplatinate, sodium chloropalladite, potassium chloroaurite, potassium aurithiocyanate, potassium chloroaurate, gold(III)chloride, gold(I)sulphide, etc.

The emulsions can comprise emulsion-stabilizers and fog-inhibiting compounds e.g. the mercury compounds such as those described in Belgian Patent Specifications No. 524,121 filed Nov. 7, 1953 by Kodak Ltd. and No. 677,337 filed Mar. 4, 1966 by Gevaert-Agfa N. V. and in published German Patent Application No. 1,622,921 filed Mar. 5, 1968 by Agfa-Gevaert AG, organic sulphur-containing compounds that form insoluble silver salts with silver ions, heterocyclic nitrogen-containing thioxo compounds or derivatives thereof, e.g. benzothiazoline-2-thione, 1-phenyl-2-tetrazoline-5-thione and 2-ethoxycarbonylthio-5-amino-thiadiazole, the compounds described in Belgian Patent Specifications No. 571,916 and No. 571,917 both filed Oct. 10, 1958 by Gevaert Photo-Producten N. V., thiazolinium compounds of the type described in Product Licensing Index, December 1971 issue, p. 90–91, benzothiazolium compounds e.g. 2,3-dimethyl-5-methoxycarbonyl benzthiazolium p-toluene sulphonate and tetra- or penta-azaindenes especially those substituted by hydroxyl or amino groups e.g. those described by Birr, Z. Wiss. Phot. 47, 2–58 (1952). A very effective azaindene emulsion stabilizer is 5-methyl-7-hydroxy-s-triazolo[1,5-a]pyrimidine which can be used together with other emulsion stabilizers e.g. those of the type described above. The emulsions may be spectrally sensitized by means of neutrocyanines, carboxycyanines, rhodacyanines, hemicyanines, merocyanines, oxonol dyes, styryl dyes and the like as described by F. M. Hamer in "The cyanine dyes and related compounds" (1954).

The emulsions may further comprise other compounds that sensitize the emulsion by development acceleration e.g. alkylene oxide polymers. These alkylene oxide polymers may be of various type e.g. polyethylene glycol having a molecular weight of 1500 or more, alkylene oxide condensation products or polymers as described in U.S. Pat. Nos. 1,970,578 of Conrad Schoeller and Max Wittwer issued Aug. 21, 1934; 2,240,472 of Donald R. Swan issued Apr. 29, 1941; 2,423,549 of Ralph Kingsley Blake, William Alexander Stanton and Ferdinand Schulze issued July 8, 1947; 2,441,389 of Ralph Kingsley Blake issued May 11, 1948; 2,531,832 of William Alexander Stanton issued Nov. 28, 1950 and 2,533,990 of Ralph Kingsley Blake issued Dec. 12, 1950 and in United Kingdom Patent Specification Nos. 920,637 filed May 7, 1959; 940,051 filed Nov. 1, 1961; 945,340 filed Oct. 23, 1961 by Gevaert Photo-Producten N. V.; 991,608 filed June 14, 1961 by Kodak Ltd. and 1,015,023 filed Dec. 24, 1962 by Gevaert Photo-Producten N. V. These development accelerating compounds may also be present in the silver halide developing solution. Other development accelerating compounds are onium and polyonium compounds preferably of the ammonium, phosphonium and sulphonium type.

Other addenda e.g. hardening agents such as formaldehyde, mucochloric and mucobromic acid, dialdehydes etc., wetting agents, plasticizers, matting agents, e.g. polymethylmethacrylate and silicon particles, light-screening dyes, etc. may be present in the silver halide emulsion or another layer of the light-sensitive silver halide materials which are to be developed by means of a hardening developer of the present invention.

The following examples illustrate the present invention.

EXAMPLE 1

Samples of a commercial X-ray film material were processed in an automatic processing machine wherein the overall processing time is 120 s and comprises developing (30 s at 34° C), fixing (30 s at 32° C), washing (30 s at room temperature) and drying (30 s ).

Development occurred by means of developing compositions obtained by mixing 1 liter of concentrate A, 1.25 liter of water and 0.25 liter of concentrate B.

| Concentrate A | |
|---|---|
| ethylene diamine tetraacetic acid | 3 g |
| 40% aqueous potassium hydroxide | 250 ml |
| potassium metabisulphite | 140 g |
| hydroquinone | 75 g |
| anhydrous potassium carbonate | 40 g |
| potassium bromide | 10 g |
| water to make | 1 litre (pH 11.80 |

| Concentrate B | | |
|---|---|---|
| Glacial acetic acid | 53 | ml |
| 1-phenyl-3-pyrazolidinone | 3.75 | g |
| benztriazol | 1 | g |
| 25% aqueous glutaraldehyde | 37.5 | ml |
| diethylene glycol to make | 250 | ml (pH 2.60) |
| The fixing solution had the following composition: | | |
| ammonium thiosulphate | 200 | g |
| sodium sulphite | 10 | g |
| boric acid | 5 | g |
| sodium acetate-3-water | 20 | g |
| glacial acetic acid | 10 | ml |
| aluminium chloride-6-water | 10 | g |
| water to make | 1 | litre. |

The developing compositions used were prepared as described above from freshly prepared concentrate B (a) and from concentrate B that after preparation was left standing for 3 weeks (b). The developing compositions either has a pH value of 10.30 (Ia and Ib) or 10.80 (IIa and IIb).

The amount of glutaraldehyde in each of these developing compositions was determined gravimetrically using 2,4-dinitrophenyl-hydrazine directly after the preparations of the developing composition and after having been left standing for 1 month.

In addition thereto the swelling was measured (in μm) at one side of the processed (before drying) double-coated X-ray film samples when development occurred with freshly prepared developing composition and with developing composition that was left standing for 1 month. The results are listed in the following table.

Table

| Developing composition | Freshly prepared glutaral-dehyde per litre | swelling | Stored for 1 month glutaral-dehyde per litre | swelling |
|---|---|---|---|---|
| Ia (pH 10.30) | 3.70 g | 6 μm | 2.46 g | 9.5 μm |
| Ib (pH 10.30) | 3.70 g | 6 μm | 3.63 g | 6.25 μm |
| IIa (pH 10.80) | 3.56 g | 7 μm | 0.30 g | 12.25 μm |
| IIb (pH 10.80) | 3.70 g | 7 μm | 3.17 g | 7.50 μm |

From the above results it is apparent that when concentrate B is stored before being admixed with concentrate A, so as to allow a reaction product to be formed between the aldehyde and the aliphatic alcohol, the developing composition ready for use retains its hardening effect.

Even at elevated pH (10.80) a developing composition of markedly improved hardening stability is obtained with the stored concentrate.

EXAMPLE 2

From a mixture of 200 ml of 25% aqueous glutardialdehyde and 150 g of ethylene glycol monomethylether, the water was continuously removed by azeotropic distillation using toluene. When no more water was distilled, the excess of ethylene glycol monomethyl ether and toluene were removed by evaporation. A residue of 117 g was obtained.

Thin layer chromatography learned that a mixture of products was formed which are strongly related in structure. According to IR and NMR-analysis as well as mass spectroscopy the main fraction appeared to have the following structure:

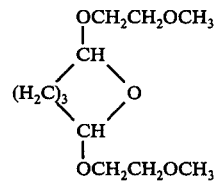

and the other fractions are most probably derivatives of glutaraldehyde wherein one or both aldehyde groups are converted into acetal groups or hemiacetal groups.

When using the reaction product obtained by the method above in neutral medium in the developer concentrate B of example 1 it was found that the hardening developer also retained its hardening effect as is illustrated by the following.

Developing compositions were prepared as described in example 1 by mixing 1 liter of concentrate A, 1.25 l liter of water and 0.25 liter of concentrate B, concentrate B however, now contained 50 ml of 25% aqueous glutaraldehyde.

Developing composition I was prepared from freshly prepared concentrate B and developing composition II was prepared from concentrate B that was stored for 3 weeks.

Another composition III was prepared from freshly prepared concentrate B wherein the glutaraldehyde solution, however, was replaced by an amount of the reaction product formed above by reaction of glutaraldehyde with ethylene glycol monomethyl ether the amount being calculated (based on the above formula) to correspond with the amount of glutaraldehyde used in concentrate B.

In each of the developing compositions the amount of glutaraldehyde (g/liter) was determined gravimetrically as described in example 1 directly after formation of the composition and after having left standing the composition for 1 month. The results were as follows:

| Developing composition | Fresh | Stored for 1 month |
|---|---|---|
| I | 4.96 g | 0.6 g |
| II | 4.90 g | 3.1 g |
| III | 4.91 g | 4.0 g |

Since these results correspond to those obtained in example 1 with the stored concentate B, complex (hemi)acetal formation is the most probable explanation for the reaction products. Since in example 1 the alcohol is a bifunctional alcohol which reacts with a bifunctional aldehyde the reaction product must be even a more complex mixture of different products than that obtained with the monalcohol of the present example.

In order to show the maintenance of hardening action and the absence of a noteworthy effect on the sensitometric characteristics by the use of the reaction product, freshly prepared developing compositions I and III were used in the automatic processing of exposed samples of a commercial X-ray film material comprising the stages of development (30 s at temperatures listed in the table hereinafter) fixing (30 s at 32° C), washing (30 s at room temperature) and drying (30 s).

The sensitometric results, determined under the same circumstances, are listed in the following table. The table also includes the moisture uptake by processing (before drying) which is a measure for the hardening.

| Developing composition | Development temp. ° C | Fog | Relative speed | Gamma | Moisture uptake |
|---|---|---|---|---|---|
| I | 36 | 0.03 | 100 | 2.69 | — |
| | 34 | 0.03 | 95 | 2.65 | 19 g/sq.m |
| III | 34 | 0.04 | 107 | 2.73 | 20 g/sq.m |
| | 32 | 0.04 | 100 | 2.64 | — |

*In the absence of a hardening agent in the developing composition the moisture uptake is 26 g/sq.m; moisture uptake is only determined for the developments at 34° C.

From the sensitometric results it would even appear that the same speed and gamma can be obtained at lower temperature when the reaction product of the invention is used instead of the glutaraldehyde.

We claim:

1. A hardening developer comprising at least one silver halide developing agent and a reaction product of an aliphatic dialdehyde hardener with an aliphatic alcohol having a boiling point above 100° C.

2. A hardening developer according to claim 1, wherein the aliphatic dialdehyde is glutaraldehyde.

3. A hardening developer according to claim 1, wherein the aliphatic alcohol is a glycol or monoalkyl ether thereof.

4. A hardening developer according to claim 1, wherein the aliphatic alcohol is a member selected from ethylene glycol, ethylene glycol monomethyl ether, ethylene glycol monoethyl ether, diethylene glycol, triethylene glycol and glycerol.

5. A hardening developer according to claim 1, wherein the developer is formed by admixture of a preformed hardener being the reaction product of; and dialdehyde hardener and said aliphatic alcohol, with common developer ingredients including a silver halide developing agent to form a hardening developer ready for use.

6. A hardening developer according to claim 1, wherein the developer is formed by mixing common developer ingredients including a silver halide developing agent with a solution containing the said reaction product of; and dialdehyde and said aliphatic alcohol.

7. A hardening developer according to claim 6, wherein the said reaction product is formed in situ in solution by storing a composition of dialdehyde and aliphatic alcohol, said dialdehyde being in aqueous form.

8. A hardening developer according to claim 6, wherein the solution containing the reaction product has a pH value between about 2 and about 5.

9. A hardening developer according to claim 1, wherein the silver halide developing agent is hydroquinone or a hydroquinone derivative.

10. A method of preparing a silver halide developer composition, which method comprising forming an acid or neutral composition which comprises a reaction product of an aliphatic dialdehyde hardener with an aliphatic alcohol having a boiling point above 100° C. and subsequently mixing such composition with an alkaline developer composition containing a silver halide developing agent.

11. A method according to claim 10, wherein the said reaction product is formed in situ in the said acid or neutral composition by mixing therein a solution of said dialdehyde hardener with said aliphatic alcohol and storing the composition for an interval of time before mixing with the alkaline developer composition containing a silver halide developing agent.

12. A method according to claim 10 wherein the said silver halide developing agent is hydroquinone or a hydroquinone derivative.

13. A method according to claim 10 wherein the aliphatic dialdehyde hardener is glutaraldehyde.

14. A method according to claim 10 wherein the aliphatic alcohol is a glycol or monoalkyl ether thereof.

15. A method according to claim 10 wherein the aliphatic alcohol is a member selected from ethylene glycol, ethylene glycol monomethyl ether, ethylene glycol monoethyl ether, diethylene glycol, triethylene glycol and glycerol.

16. A method according to claim 10 wherein said composition comprising said reaction product which is mixed with the alkaline developer composition has a pH value between about 2 and about 5.

17. A method according to claim 10 wherein the said acid or neutral composition, which is mixed with the said alkaline composition contains an auxiliary silver halide developing agent which has a superadditive effect when used together with a hydroquinone silver halide developing agent.

18. A method according to claim 17 wherein the auxiliary developing agent is a 3-pyrazolidinone developing agent.

19. A method according to claim 17 wherein the auxiliary developing agent is 1-phenyl-3-pyrazolidinone or 1-phenyl-4-methyl-3-pyrazolidinone.

20. A method according to claim 10 in which the developer composition is diluted with water.

* * * * *